US005360313A

United States Patent [19]

Gilmore, Jr. et al.

[11] Patent Number: 5,360,313

[45] Date of Patent: Nov. 1, 1994

[54] COUPLING FOR HEAVY-DUTY MACHINE

[75] Inventors: Charles P. Gilmore, Jr., Oto, Iowa; Dale R. Johnson, Hudson, Wis.

[73] Assignee: Gilmore Transportation Services, Inc., Missouri Valley, Iowa

[21] Appl. No.: 147,169

[22] Filed: Nov. 3, 1993

Related U.S. Application Data

[63] Continuation of Ser. No. 919,915, Jul. 27, 1992, abandoned.

[51] Int. Cl.[5] ..... E02F 9/00

[52] U.S. Cl. ..... 414/694; 403/45; 414/723; 414/722; 414/686

[58] Field of Search ..... 414/694, 722, 723, 727, 414/686; 403/339, 340, 364, 43, 45, 48, 14; 411/107, 432; 37/468; 172/272–275

[56] References Cited

U.S. PATENT DOCUMENTS

| | | | |
|---|---|---|---|
| 3,243,066 | 3/1966 | Gardner et al. | 414/723 X |
| 3,934,738 | 1/1976 | Arnold | 172/272 X |
| 4,208,163 | 6/1980 | Holmqvist | 414/723 |
| 4,373,852 | 2/1983 | Maurer | 414/723 |
| 4,545,720 | 10/1985 | Cochran et al. | 414/723 |
| 4,571,146 | 2/1986 | Eriksson | 414/687 |
| 4,586,867 | 5/1986 | Stafford | 414/723 |
| 4,643,631 | 2/1987 | Maurer et al. | 414/723 |
| 4,761,113 | 8/1988 | Smith et al. | 414/723 X |
| 4,813,163 | 3/1989 | Livingston | 414/723 X |
| 4,836,741 | 6/1989 | St. Louis et al. | 414/723 |
| 4,938,651 | 7/1990 | Gilmore et al. | 414/694 |
| 4,955,779 | 9/1990 | Knackstedt | 414/723 |
| 5,107,610 | 4/1992 | Fusco | 414/723 X |
| 5,108,252 | 4/1992 | Gilmore, Jr. et al. | 414/694 |
| 5,147,173 | 9/1992 | Fauber et al. | 414/723 |

OTHER PUBLICATIONS

Balderson Coupler brochure, Oct., 1977.
American Coupler Systems brochure, Apr., 1983.

*Primary Examiner*—Donald W. Underwood
*Attorney, Agent, or Firm*—Lloyd L. Zickert; Adam H. Masia

[57] ABSTRACT

A coupling for a heavy-duty machine to be used between a boom and a stick having a working tool for quick coupling and decoupling of the stick to the boom for the exchange of tools and being operable from the cab or operator's station on the machine without requiring the need for one or more persons or machines at the coupling during the coupling and decoupling process. The coupling also includes a unique locking mechanism that can be remotely controlled to lock and unlock the coupling when they are in mating engagement. The coupling includes a male member attachable to the boom of the machine and a female member connected to the stick. The male member is pivotally mounted at one end on the boom and connected at the other end to a hydraulic cylinder on the boom for articulating the male member on the boom. The male member further includes a grabber at one end and a picker at the other end for interchangeable use to guide the joining of the coupler members. The male and female members are symmetrically constructed so that either end of one member may be aligned with either end of the other. The coupling also includes a unique locking mechanism that can be remotely controlled to lock and unlock the coupling when they are in mating engagement. Further, the coupling includes unique hydraulic couplings for connecting a source of hydraulic power from the machine to the stick that may be just mated together or provided with remotely operable locking means.

46 Claims, 8 Drawing Sheets

FIG. 11
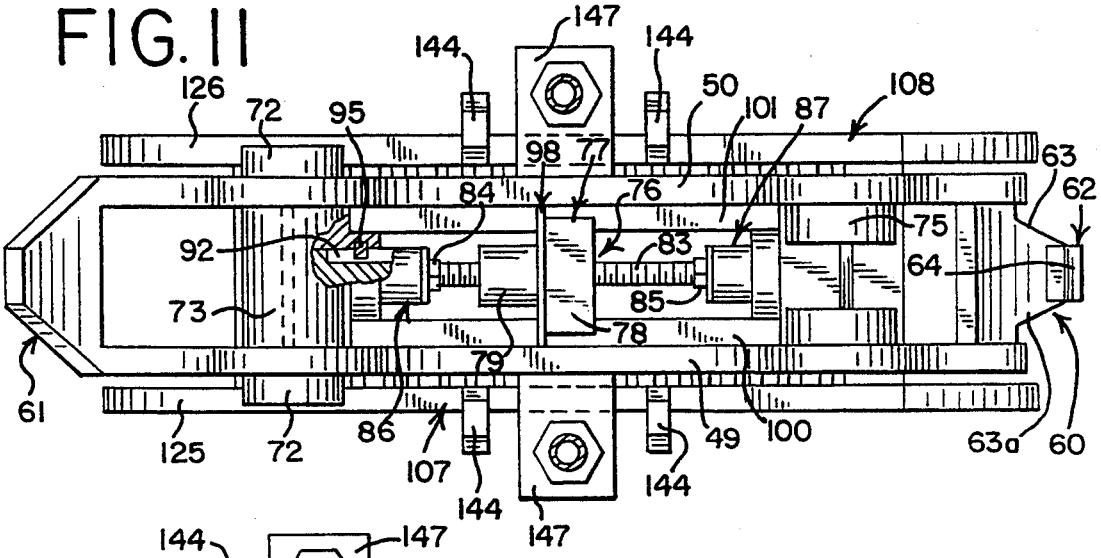
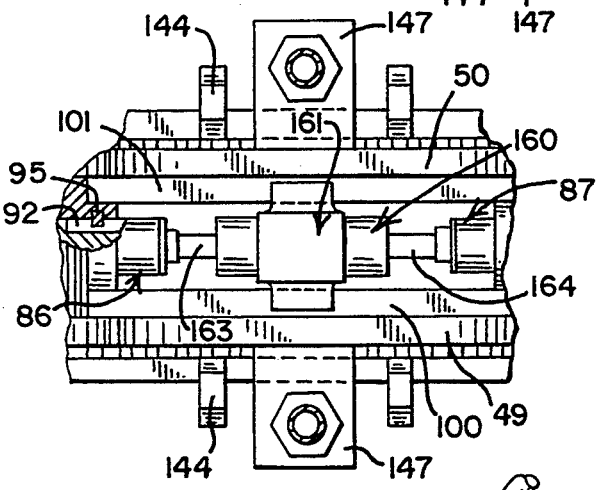
FIG. 13
FIG. 12
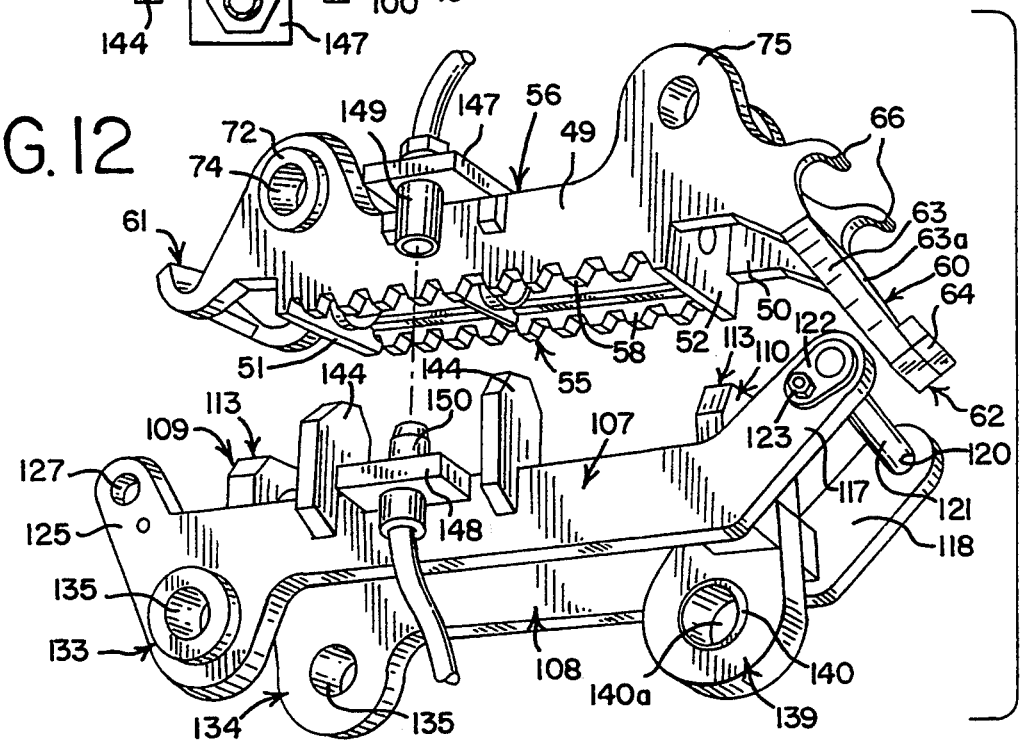

COUPLING FOR HEAVY-DUTY MACHINE

This application is a continuation of copending application Ser. No. 07/919,915, filed Jul. 27, 1992, now abandoned.

DESCRIPTION

This invention relates in general to a coupler for a heavy-duty machine to enable the quick coupling and decoupling between a boom on the machine and a stick having a tool so that the machine may be easily used for sticks having different working tools, and more particularly to a coupling that may be remotely operated by the operator of the machine, and still more particularly to a coupler having symmetrically constructed coupling members and a unique locking mechanism for firmly locking the coupling members together, and still more particularly to a coupler having unique hydraulic couplings for connecting a source of hydraulic power from the machine to the stick.

BACKGROUND OF THE INVENTION

Heretofore it has been well known to provide a remotely operable coupling between the boom of a heavy-duty machine and a stick, as described in U.S. Pat. Nos. 4,938,651 and 5,108,252. These prior known couplings included the use of intermeshing gear teeth for providing a firm connection between the coupling members to substantially eliminate play between the boom and the stick during operation of the tool on the stick. The coupling members include locking means for locking the members together in the form of articulated T-bars in the first patent and in the form of threaded shafts and nuts in the second patent.

Further, these prior known couplers included a grab bar on one end of the male coupling member for coacting with a pin on one end of the female coupling member for guiding the two members together, thereby allowing only one end of the male member and only one end of the female member to be used for initially guidably bringing together the two members.

SUMMARY OF THE INVENTION

The present invention is an improvement over the above referred to prior known couplers in that the male member of the present invention is capable of guidably mating with the female member from either end of the male member and either end of the female member. The members are symmetrical so that either end of one member may be aligned with either end of the other member. Additionally, the locking mechanism for locking the two members together is unique and an improvement over the locking mechanisms of the prior known couplers. Further, the female member of the present invention includes a feature to compensate for misalignment and/or space differences found on pin openings of sticks to which the female member may be pin connected.

It is therefore an object of the present invention to provide a new and improved quick-disconnect coupler for use between a boom of a heavy-duty machine and a stick, so that sticks with different working tools may be readily interchanged.

Another object of the present invention resides in the provision of an improved quick-disconnect coupler having symmetrically constructed male and female coupling members so that either end of one coupling member may be aligned with either end of the other coupling member when the two coupling members are brought together into coupling engagement.

A further object of the present invention is in the provision of a new and improved coupler for use between the boom of a heavy-duty machine and a stick which includes a unique locking mechanism that is provided with wedge-shaped bars for producing a wedge locking function between the male member and the female member of the coupler.

Another object of the present invention is in providing a new and improved quick-disconnect coupler to be used between a boom of a heavy-duty coupler and a stick and which allows the male member to be guidably brought together with the female member at either end of the male member by providing a grabber at one end and a picker at the other end to coact with a pin interchangeably mounted at either end of the female member.

Still another object of the present invention is to provide a new and improved quick-disconnect coupler where the female member includes pin bosses for providing a pin connection to a stick and one of the bosses includes an eccentric mounted bushing that facilitates the pin mounting by compensating for misalignment and/or spacing differences of different sticks.

A still further object of the present invention is in providing a remotely operated quick-disconnect coupling having a locking mechanism that may be hydraulically, electrically or pneumatically driven between locking and unlocking positions.

Other objects, features and advantages of the invention will be apparent from the following detailed disclosure, taken in conjunction with the accompanying sheets of drawings, wherein like reference numerals refer to like parts.

DESCRIPTION OF THE DRAWINGS

FIG. 11 is a plan view of the coupling of the invention showing the pin on the female member at the picker end and illustrating the manner in which threaded shafts and a gearbox assembly drives the locking mechanism and is slidably mounted on the male member;

FIG. 12 is an exploded perspective view of the coupling members also showing the aligning pin of the female member positioned at the picker end of the female member;

FIG. 13 is a fragmentary plan view like FIG. 11 but showing another embodiment where the locking mechanism is driven by a hydraulic cylinder.

DESCRIPTION OF THE INVENTION

Figure 1:
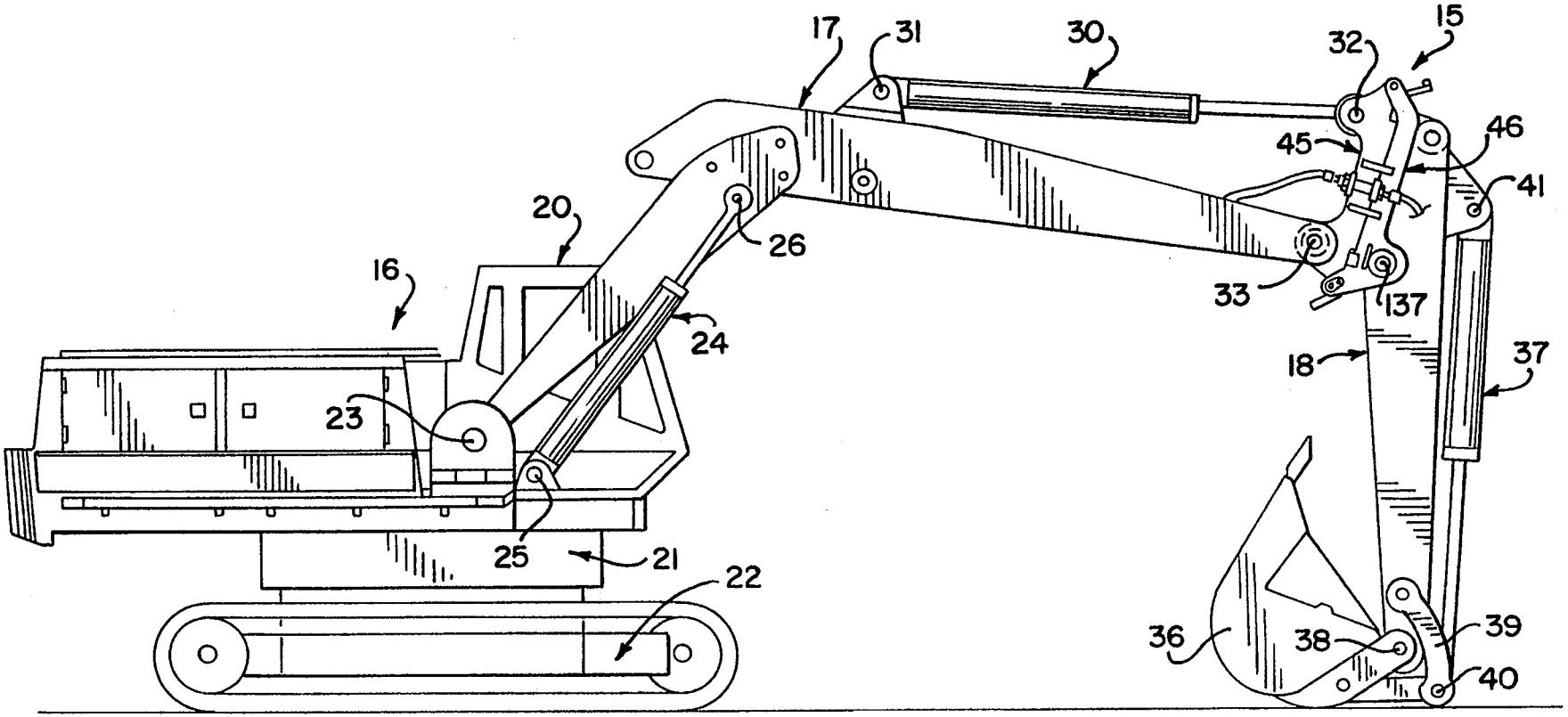
FIG. 1 is a side elevational view of a heavy-duty machine having a boom that is connected to a stick having a tool by the quick-disconnect coupling of the present invention.

Referring now to the drawings, and particularly to FIG. 1, the improved coupling of the present invention, generally indicated by the numeral 15, is illustrated on a heavy-duty machine 16 having a boom 17 and a stick 18. The coupling 15 is connected between the boom and the stick and is constructed for use on any heavy-duty machine having a boom for quick interchangeability of sticks having various tools or working members. This not only includes the track-mounted machine illustrated but would also include tire-mounted machines such as a backhoe. The heavy-duty machine includes a cab or operator station 20 on a carriage or base 21 which in turn is rotatably supported on a track drive 22.

The boom 17 is pivotally connected at one end to the machine at 23 and articulated in a vertical direction by means of a hydraulic cylinder 24 pivotally connected at one end at 25 to the machine base 25 and pivotally connected at the other end to the boom at 26 in a known manner. Thus, operation of the hydraulic cylinder 24 swings the boom vertically up or down.

The boom also includes on its upper side a stick cylinder 30 pivotally connected to the boom at one end at 31 and pivotally connected at the other end to the coupling 15 at 32. The coupling is also pivotally connected to the end of the boom at 33.

Figures 2, 14:
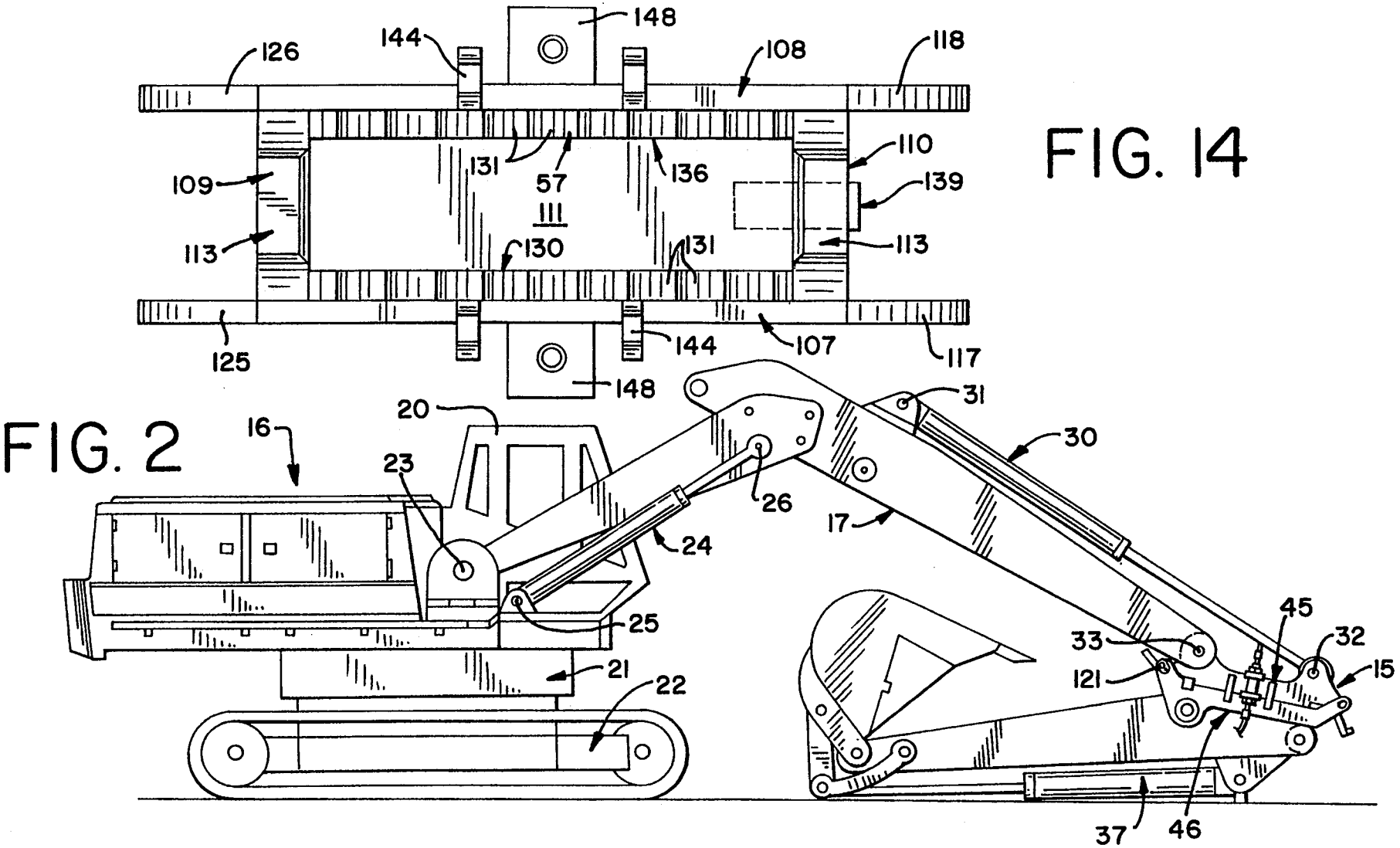
FIG. 2 is also a side elevational view of the machine in FIG. 1 with the stick positioned on the ground beneath the boom and in a position where the coupling members may be interconnected.
FIG. 14 is a plan view of the female coupling member of FIG. 12, looking at the front side or mating face.
Figure 3:
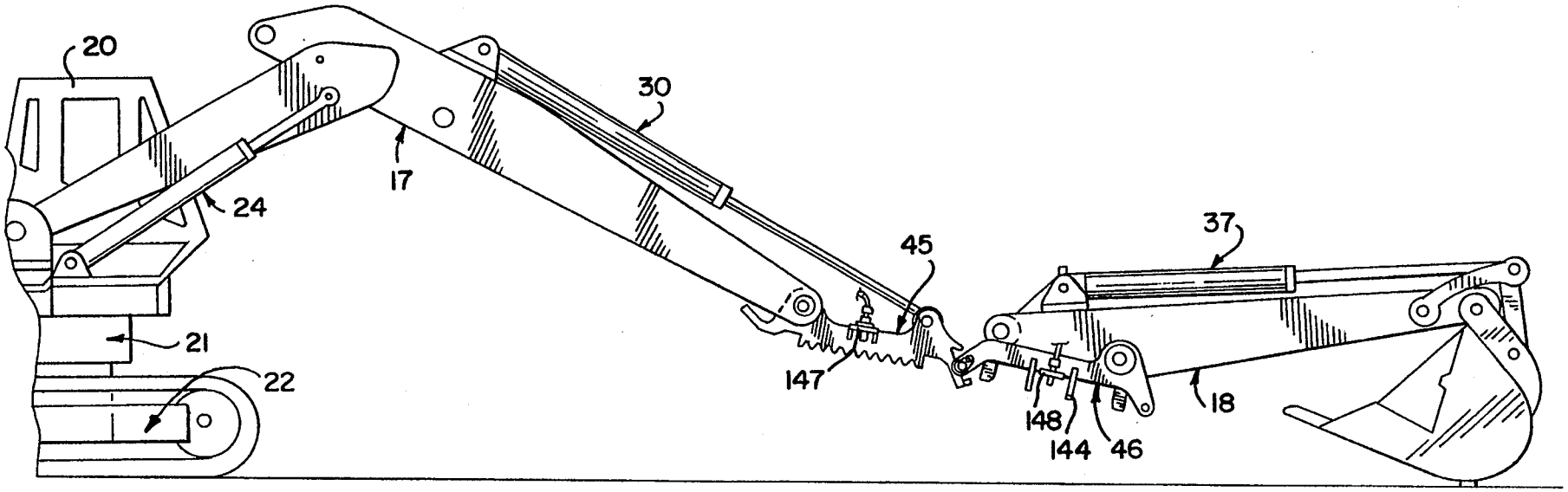
FIG. 3 is a fragmentary side elevational view of the machine with the boom extended and the stick extended to illustrate interconnecting the coupler.
Figure 4:
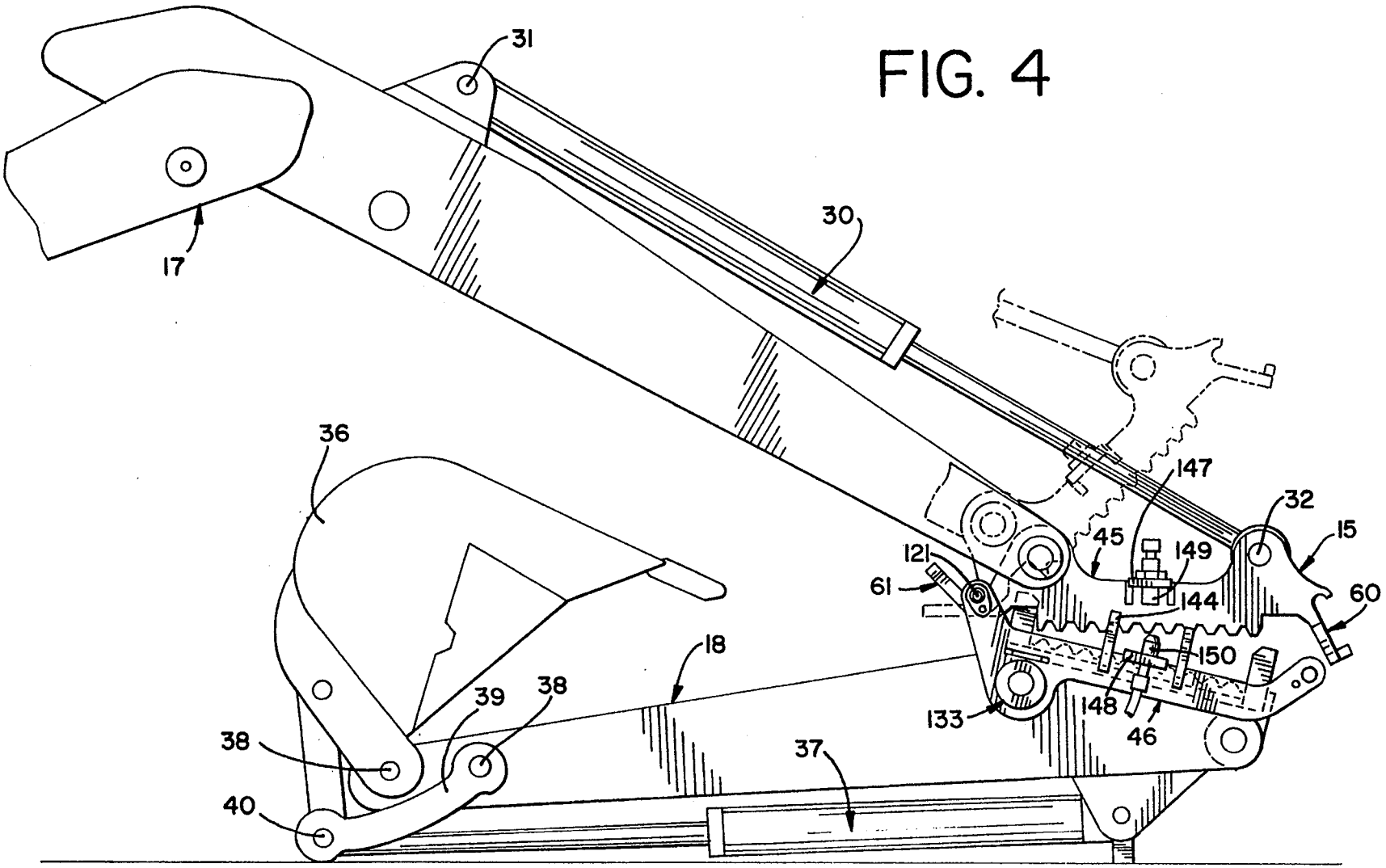
FIG. 4 is an enlarged elevational view of the stick lying horizontally on the ground beneath the boom and illustrating the manner in which the coupling members are brought together, wherein the grabber is being utilized for guidably bringing the coupling members together.
Figure 5:
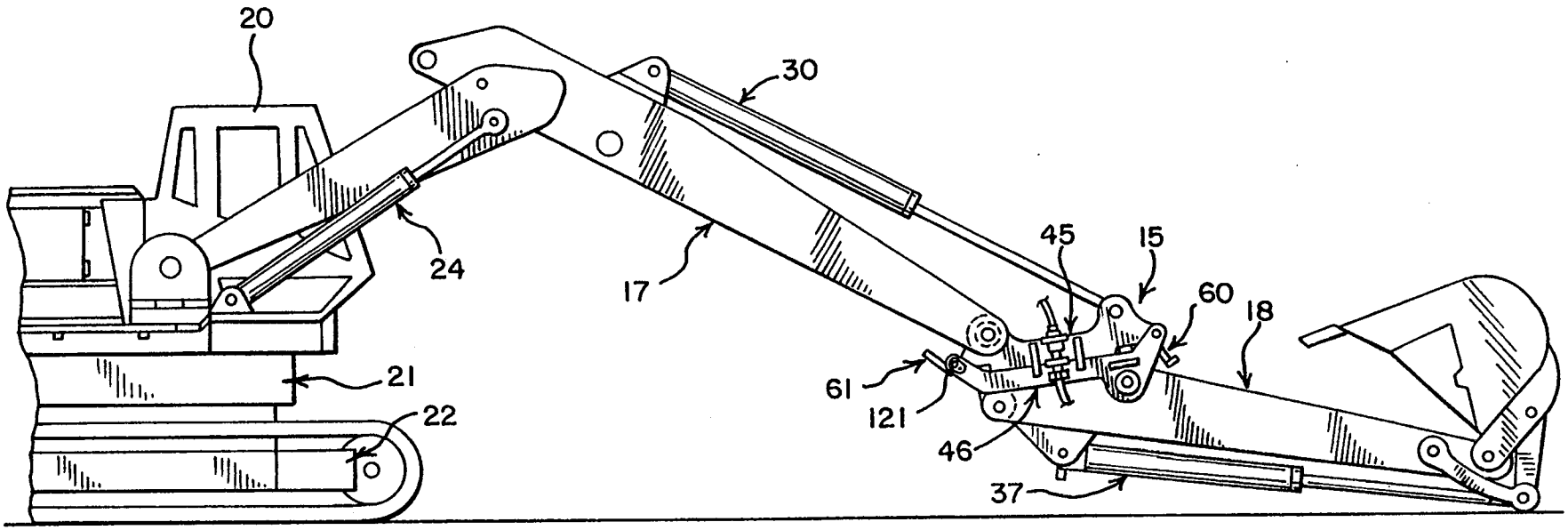
FIG. 5 is a fragmentary view of the machine and illustrating the manner in which the boom and stick can be connected by the coupling member where the grabber end of the male coupling member is used to bring the coupling members together but where the relative ends of the coupling member are reversed from what is illustrated in FIGS. 1 to 4 thereby demonstrating the symmetrical formation of the coupling members.

The stick 18 includes a bucket 36 and a bucket-operating cylinder 37. The bucket 36 is pivotally connected to the end of the stick at 38 and includes linkage 39 which is pivotally connected to one end of the cylinder 37 at 40. The other end of the cylinder 37 is pivotally connected to the upper end of the stick 18 at 41. It will be understood that the coupling 15 may be coupled or decoupled while the stick is on the ground and underneath the boom, as shown in FIGS. 2 and 4, or while the stick is in extended position on the ground, as seen in FIG. 3. Moreover, because the coupling members of the coupling 15 are symmetrical such that either of the ends may be aligned with each other, as described below, the stick may be mounted in an upside-down fashion, as shown in FIG. 5.

For purposes of simplicity, not all of the various hydraulic lines are illustrated in the drawings for the hydraulic cylinders and for connecting to the hydraulic power source generated by the machine 16.

The coupling 15 includes a male coupling member 45 connected to the boom and stick cylinder and a female member 46 mountable on the stick 18. While the female member will be described and as illustrated as being pin-connected to the stick, it should be appreciated that it could be welded to the stick or bolted to the stick. Where the female member is welded or bolted directly to the end of the stick, the frame of the female member will not need to include the pin bosses as will be referred to below.

It should also be appreciated that while the stick 18 is shown as including a bucket as the working tool, other sticks having other working tools may be provided with female coupling members to be interchangeable so that the heavy-duty machine may serve to easily accomplish different working functions. For example, a stick with a grapple or a shears may be easily interchangeably used on the machine.

The male coupling member includes a frame having a pair of parallel spaced apart side plates 49 and 50 connected together near the opposite ends by cross walls 51 and 52, as seen in FIGS. 11 to 13. It will be appreciated that the entire coupling is made of a suitable steel and that the thickness of the plates and cross walls is such that as a frame it will withstand all of the forces subjected to it during the use of the coupling by the heavy-duty machine. The side frame plates include a mating face 55 and a backside 56, FIG. 12. The mating face 55 is adapted to mate with the mating face 57, FIG. 14, of the female member 46. Along the mating face of each of the frame plates 49 and 50 are a series of teeth 58. These teeth are preferably in the form of gear teeth and take the appearance of a rack gear at each side of the coupling member.

The male coupling member includes at the upper or head end a picker 60 and at the lower or toe end a grabber 61, each of which guidably assists in bringing together the coupling members during the coupling operation depending on which end is desired to be used and which end of the female member includes a pin, as will be described below.

The picker includes a head member 62 and a flat body member 63 where the head member is at the outer end of the body member. The head member 62 is provided with a bar 64 that extends upwardly from the face 63*a* of the body to define a lip which assists in engaging the pin on the female member during coupling when the pin is at the head end of the female member. The body 63 is tapered toward the head 62, as seen particularly in FIG. 11, so that it defines slanting edges which assist in centering the picker on the corresponding end of the female member during the coupling process. At the end of the body 63 opposite the head member 62, positioning hook elements 66 are formed on the frame side plates 49 and 50 to engage the pin and further assist in properly positioning the corresponding end of the female member with the male member during the coupling function so that the intermeshing elements of each member matingly engage.

The grabber 61 is mounted at the toe end of the male member to assist in guidably interconnecting the male and female members when the pin on the female member is located at the toe end of the female member. The grabber 61 is somewhat in the form of a beaver tail and defines a hook that opens in the opposite direction from the hook members 66 at the head end of the male member. Thus, the action in interconnecting the male member with the female member is somewhat different when utilizing the grabber than when using the picker. As particularly seen in FIG. 11, the grabber 61 also tapers toward the free end to provide edges that assist in centering the corresponding end of the female member with the male member so that there is alignment established prior to the mating faces of the members coming together. Further, the grabber is shaped like a hook to engage and cradle the pin of the female member and position the respective ends of the members so the intermeshing elements of each member matingly engage.

At the toe end of the male member and also at the backside, pin bosses 72 are provided at each side plate and are interconnected between the plates with a sleeve 73 for the purpose of providing a pin hole 74 that coacts with pin holes on the free end of the boom 17 to receive the pin 33 for pin-connecting the lower or toe end of the male member to the end of the boom so that the lower end of the male member can pivotally swing in a vertical direction relative to the end of the boom.

Also on the backside of the male member and at the upper or head end, pin bosses 75 are provided on the inner sides of plates 49 and 50 to define pin holes 75*a* for coacting with pin 32 to interconnect one end of the stick cylinder 30 to the upper or head end of the male member whereby actuation of the cylinder will cause pivotal swinging of the male member in a vertical plane.

Also provided on the male member is the operator-actuated locking mechanism 76 which includes in the embodiment of FIGS. 7 to 12 a gearbox and motor assembly 77 having a gearbox 78 and a motor 79. The motor 79 is preferably hydraulic, but it could be electrical or of any other suitable type if desired. As seen particularly in FIG. 6, the gearbox 78 includes a pinion gear 80 meshing with a drive gear 81. The pinion gear is connected to the motor 79 by means of a shaft 82. The drive gear 81 is keyed to an Acme threaded shaft 83 having right-hand threads on one side of the drive gear 81 and left-hand threads on the other side of the drive gear 81 for respectively engaging like threaded nuts 84 and 85 that are directly connected to wedge-shaped locking bars 86 and 87. As seen particularly in FIGS. 7 and 8, the locking bars are generally cylindrical in shape and provided at their ends with wedge or slanted surfaces 88 and 89, respectively, that ultimately coact with sockets formed on the female member as described below. The wedge-shaped bars 86 and 87 are respectively guided for reciprocal movement in guide bushings or guideways 90 and 91 having suitable mating cylindrical bores 90*a* and 91*a*. In order to prevent the wedge-shaped locking bars from rotating in the bushings, they are provided with longitudinally extending keyways slots 92 and 93 at their outer surface which coact with pins or keys 95 and 96 that extend from the guide bushings 90 and 91. The keyways are provided at opposite sides of each wedge-shaped bar for engaging pins or keys at opposite sides that are fixed to the guideways. The keyways open to the inner ends of the bars, and terminate inwardly at a point to allow the ends of the bars to come free of the sockets when the bars are moved to unlock positions. Additionally, the pins 95 and 96 serve as stops to prevent the wedge-shaped bars from coming out of the guideways 90 and 91 and also to stop movement of the bars when one bar comes free of its socket prior to the other, as described below.

Figures 7, 8, 9, 10:
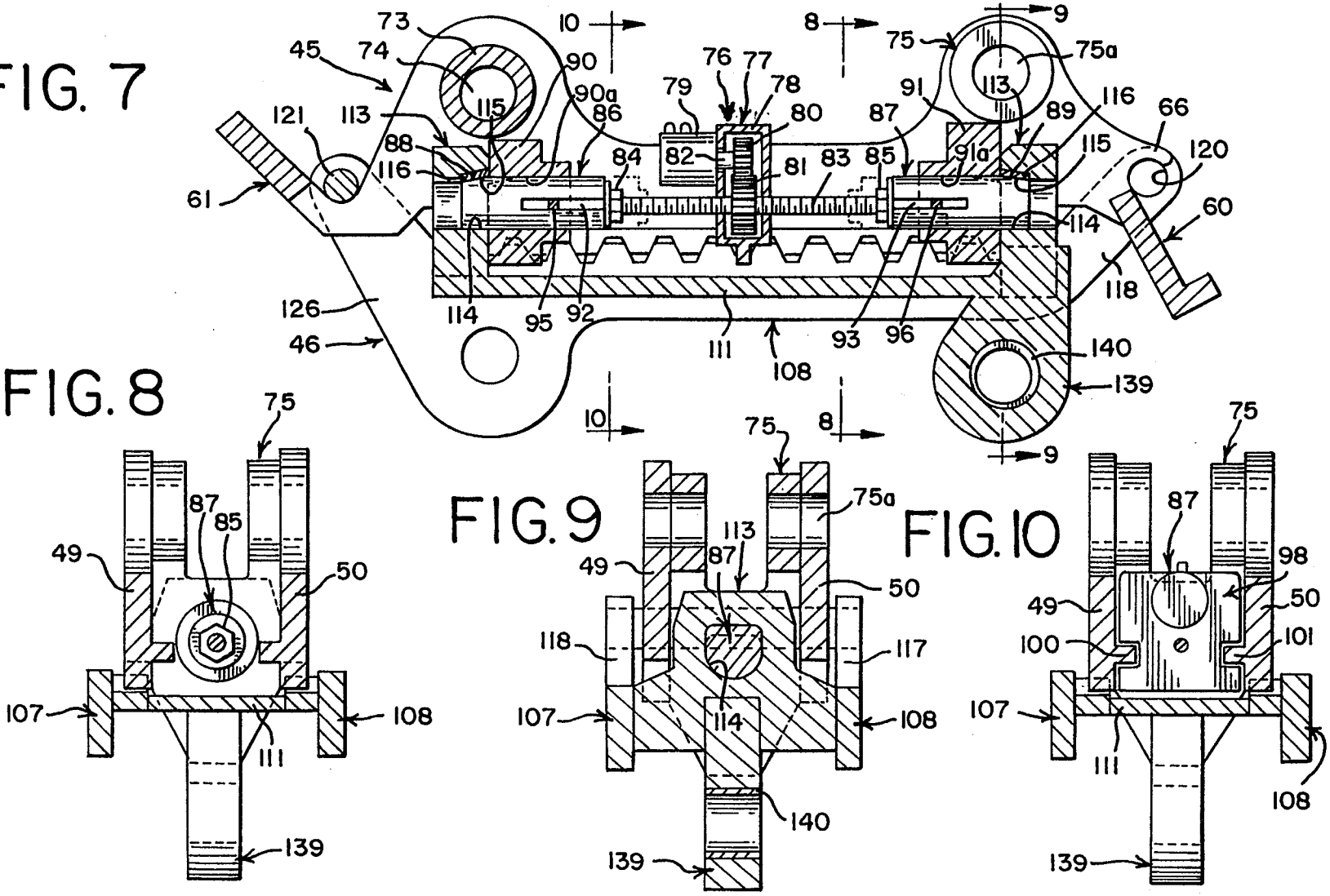
FIG. 7 is an enlarged longitudinal sectional view of the coupler of the present invention to show underlying parts and showing the pin for the female member at the end for utilizing the grabber to bring the coupling members together.
FIG. 8 is a vertical sectional view taken substantially along line 8—8 of FIG. 7.
FIG. 9 is a vertical sectional view taken substantially along line 9—9 of FIG. 7.
FIG. 10 is a vertical sectional view taken substantially along line 10—10 of FIG. 7.

The motor and gearbox assembly 77 is slidably mounted on the male member so that if one of the wedge-shaped bars seats before the other, the assembly can slide or float and cause seating of the other wedge-shaped member so that equal force is applied to both when they are in seated and locked position. Similarly, if one bar unseats or goes to unlock position before the other and is stopped by the pins/slots for that bar, the motor and gearbox will float or slide during retraction of the other bar. As seen in FIGS. 10 and 11, a generally rectangular plate 98 is provided to which the motor and gearbox assembly is mounted. The plate 98 is sized to fit within the parallel side plates 49 and 50 and additionally prevent relative rotation of the motor and gearbox assembly in the male member. Further, the plate 98 is notched to slidably ride on rails 100 and 101 which extend inwardly from the side plates 49 and 50 of the male member. Thus, the motor and gearbox assembly is mounted within the male member so that it can float or move to accommodate the locking or seating and the unlocking or unseating of the wedge-shaped members.

The female coupler member 46 includes two parallel spaced and elongated side plates 107 and 108 interconnected at opposite ends by transversely extending end plates 109 and 110, as seen particularly in FIGS. 12 and 14. Extending between the end plates 109 and 110 and also between the side plates 107 and 108 is a bottom plate 111, as particularly seen in FIGS. 7, 8 and 14. The upper ends of the end plates 109 and 110 are in the form of a tooth 113 which has opposed tapered corners and which serves to interengage in tooth sockets on the male coupling member formed by the frame side plates 49 and 50 to control lateral movement between the coupling members. The manner in which interengagement is accomplished is illustrated particularly in FIG. 9. Further, these tooth-shaped sections include sockets 114 for receiving the wedge-shaped bars 86 and 87 of the locking mechanism on the male member. The sockets at the top of the inlet end are provided with a slanting surface 115 defined by a replaceable wear plate 116 to mate with the wedge-shaped surfaces 88 and 89 on the wedge-shaped bars 86 and 87 when the bars are in locked position. Preferably, the slanting surface 115 extends at about a 15 degree angle from the horizontal.

At the top or head end of the female member, arms 117 and 118 extend upwardly from and at an angle to the side plates 107 and 108 and are provided with aligned holes 120 for receiving a pin 121 that, as seen in FIG. 11, coacts with the picker 60 during the initial guiding together of the male and female members. The pin may be solid or tubular as desired and is held in place by a retaining plate 122 fixed at one end of the pin so that when the pin is in place the plate will lie against the outside surface of the female member side plate 107 and be fixed to the side plate 107 by a bolt 123. This pin is interchangeably mountable at the toe end of the female member, as described below.

At the toe end of the female member, upwardly and outwardly extending arms 125 and 126 include pin holes 127 that are aligned with each other and permit the mounting of the aligning pin 121 when it is desired to utilize the grabber 61 for accomplishing the initial aligning and interengagement of the female and male members. Thus, the pin 121 is interchangeable for mounting at either end of the female member depending on whether the picker 60 is to be used or the grabber 61 is to be used during coupling.

Within the confines of the female member side plates 107 and 108 and on the bottom plate 111 are two parallel rows 130 of gear teeth 131. The gear teeth 131 of the female member mate with gear teeth 58 on the male member during coupling of the members. The gear teeth tightly mate to prevent relative longitudinal movement between the members along the longitudinal axes. The single gear teeth on the female member serve to prevent relative lateral movement between the members along the transverse axes of the members. As seen particularly in FIGS. 8 and 9, the side plates 49 and 50 of the male member are spaced to come within the side plates 107 and 108 of the female members when the members are in coupled relation. It will also be appreciated that when the members are brought together in seated relation the sockets 114 on the female member will align with the wedge-shaped bars 86 and 87 on the male member so that the wedge-shaped bars can properly engage in the sockets to lock the male and female members together.

As previously mentioned, the male and female coupling members are symmetrically constructed relative to the meshing operation of the gear teeth and the interengagement between the pin on the female member as it relates to the shape of the picker 60 and hook 66, as well as the grabber 61. This relationship may be seen in FIG. 7. Because of the symmetry of the interengaging parts, the coupling members may be brought together with their head ends or toe ends aligned, or they may be brought together where the head end of one member aligns with the toe end of the other member at each end. Thus, it makes no difference whether the wedge-shaped bars mate with the sockets of either of the end plates 109 or 110 of the female member.

When the pin 121 of the female member is at the toe end, the grabber 61 of the male member engages and coacts with the pin for coupling purposes, as shown in FIG. 4. In this arrangement, the stick is positioned below the boom so that the grabber can interengage between the arms 125 and 126 of the female member and mate with the pin 121, after which the stick cylinder can be actuated to bring the male coupling member into engagement with the female coupling member on the stick, as illustrated in FIG. 4.

Where the stick is in fully extended position as shown in FIG. 3, the pin is mounted at the head end of the female member so that the picker 60 can function to engage the pin and gradually move upward until the coupling members come together so they can be locked by the locking mechanism. Controls in the cab of the machine will be used to operate the locking mechanism. Thus, the coupler of the invention is capable of coupling operations by first bringing the head ends of the coupling member or by first bringing the tail ends of the coupling member together.

Further, because of the symmetry in the coupling members, it is also possible to bring the coupling members together so that the head end of one coupling member mates with the toe end of the other coupling member at each end. This is illustrated in FIG. 5 where the stick with the bucket is turned upside-down. The pin is mounted at the head end of the female member and will be engaged by the beaver end 61 or the toe end of the male coupling member. Similarly, the head end of the male coupling will then engage or mate with the toe end of the female member. Where hydraulic power is utilized on the stick, as in the case where a bucket is the working tool, the controls are reversed as to operation of the bucket because the hydraulic connections are reversed. Connecting the bucket on the stick in this manner, as shown in FIG. 5, would allow the machine to use the bucket for working against a surface that is elevated.

Figure 6:
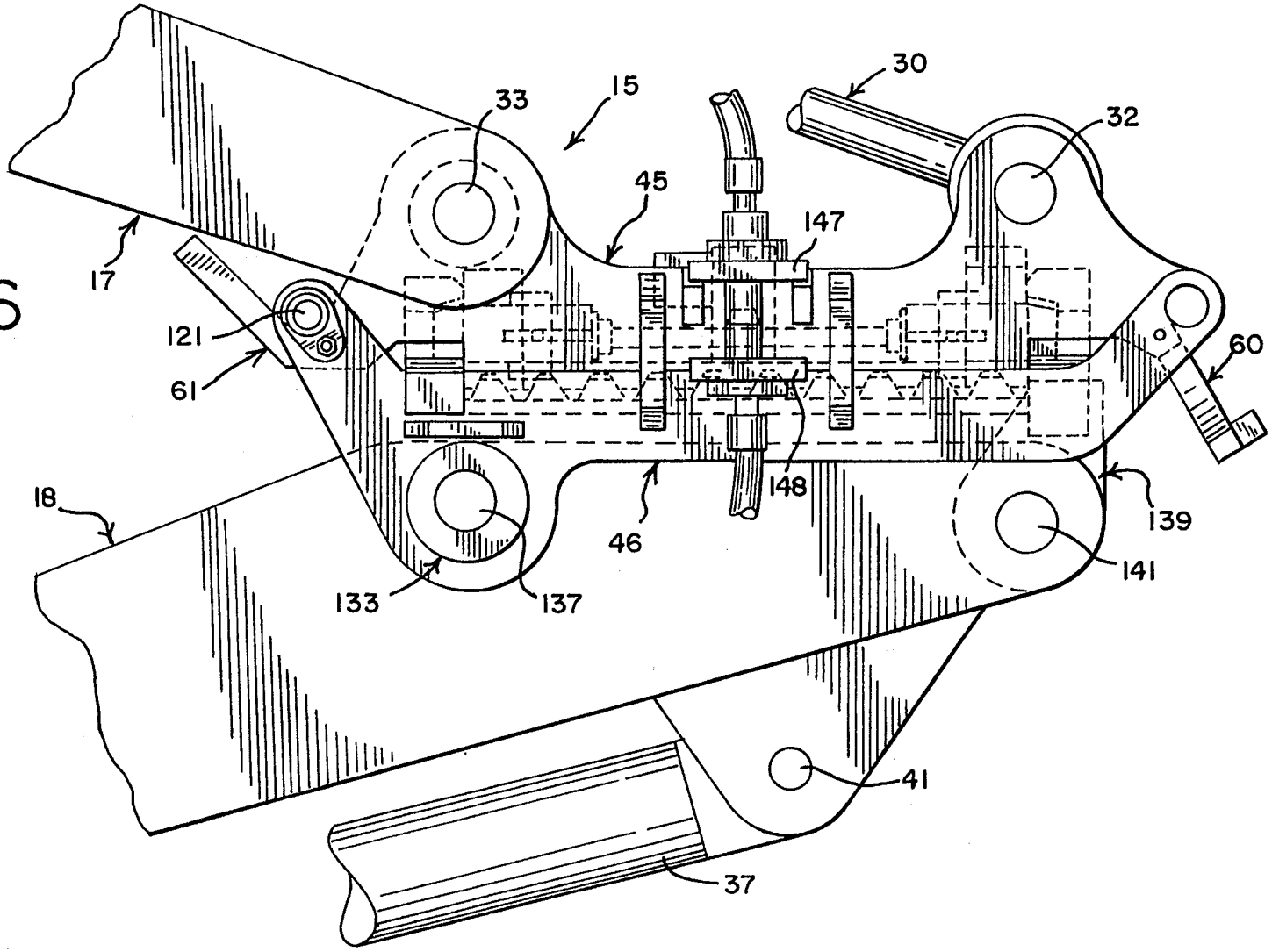
FIG. 6 is an enlarged side elevational view of the coupling according to the invention in joined and locked position showing underlying parts in phantom to illustrate the locked position of the locking mechanism.

The female member of the embodiment illustrated includes pin bosses for pin-connecting the female member to a stick having the standard pin holes although it should be appreciated that the female member could be formed for direct welding or bolting to a stick. The side plates 107 and 108 at the lower end include pin bosses 133 and 134 with aligned pin openings 135 for pin-connection of one end of the female member to the stick by means of a pin 137, as seen particularly in FIGS. 1 to 6. At the upper or head end of the female member, a single pin boss 139 is suitably secured to the upper end plate 110 and centered so that it can fit between a bifurcated end of the stick. An eccentric bushing 140 having a pin hole **140*a* is received in the pin boss 139 and may be adjustably rotated within its circular socket in order to compensate for minor spacing and/or misalignment differences between the pin holes 135 and 140*a* that may occur in different sticks. As seen in FIG. 6, a pin 141 is provided to pin-connect the pin bushing 139** to the outer end of the stick.

As shown particularly in FIG. 12, aligning bars 144 may be provided on the female member side plates 107 and 108 for the purpose of additionally enhancing alignment between the male and female members as they are brought together into coupling relation. The aligning bars are beveled at their ends to facilitate centering of the male member with respect to the female member as the two members come together. Further, the aligning members fit on the outer sides of the side frame plates 49 and 50 of the male coupling member, as shown in FIGS. 1 and 4. While the aligning members are mounted on the female members, it should be appreciated that they could be optionally mounted on the male members.

Also as shown particularly in FIGS. 11 and 12, plates 147 may be provided on the male member 45 and plates 148 may be provided on the female member 46 for purposes of receiving hydraulic fittings where it is necessary to provide hydraulic power to a hydraulic cylinder on a stick, such as illustrated in FIGS. 1 to 4 by the working tool hydraulic cylinder 37 which drives the bucket. The plates extend perpendicular to the side plates of the coupling members. The plates 147 are shown having mounted thereon female hydraulic fittings 149, while plates 148 are shown having mounted thereon male hydraulic fittings 150. It will be appreciated that the plates and hydraulic fittings will be mounted on the coupling member so that they align with one another to couple with each other as the coupling members are brought together. Accordingly, a hydraulic power connection between the male and female coupling members can easily be established with the coupling operation.

Preferably, the fittings are of a type that include valves which close upon separation and open upon full engagement in order to minimize the loss of hydraulic fluid during the decoupling and coupling of the fittings. It should also further be appreciated that other types of hydraulic fittings, such as fittings with manual valves, may be provided for the coupling members where it is desired to hydraulically connect the power source of the heavy-duty machine with hydraulic cylinders actuable on the stick. While not shown, it should be appreciated that the hydraulic couplings could be made such as to have power driven locking means operable from the cab to lock the couplings together like in U.S. Pat. No. 5,108,252 or other types that include threaded members. Further, the fittings may be mounted on one side instead of both sides, and any number of fittings may be utilized to provide hydraulic power to more than one hydraulic motor or cylinder.

Another embodiment of the invention is shown in FIG. 13 which differs from the first embodiment in that a hydraulic cylinder is used for driving the locking mechanism on the male member in place of the mechanical driving system used in the embodiment of FIG. 11. Referring to FIG. 13, a hydraulic cylinder 160 is mounted on a carriage 161 slidable on the plate rails 100 and 101. The same slots would be in the bars which would work with the pins in the guide bushings to prevent rotation of the bars and prevent the bars from sliding free of the bushings. The stops could also function during unseating of the wedge-shaped bars, as previously explained. The hydraulic cylinder includes a piston rod 163 connected to the wedge-shaped bar 86, and a piston rod 164 connected to the wedge-shaped bar 87. Each piston rod would be connected to a piston in the cylinder where connecting pressure to the chamber between the pistons would drive the piston rods to drive the wedge-shaped bars 86 and 87 into seated or locked position. Venting the chamber between the pistons and applying pressure to the rod sides would drive the bars into unseated or unlocked position. Should one bar seat before the other, once it is seated the cylinder could slide in the frame if necessary. Similarly, in the unlocking operation, if one bar unseated before the other, once it reached the stop it would force the cylinder to slide until the force would cause the other bar to unseat.

It may also be appreciated that a pneumatic cylinder may be used in place of the hydraulic cylinder, and that other hydraulic cylinder systems could be used. For example, a double-acting hydraulic cylinder could be used with a single piston rod connected to one of the wedge-shaped bars, and the cylinder could be connected to the other bar.

In view of the foregoing, it should be appreciated that the present invention provides an improved quick-disconnect coupler for heavy-duty machines having an improved mechanism for locking the coupling members together, and which includes coupling members having a symmetry allowing them to couple in either direction and beginning from either end.

It will be understood that modifications and variations may be effected without departing from the scope of the novel concepts of the present invention, but it is understood that this application is to be limited only by the scope of the appended claims.

The invention is hereby claimed as follows:

1. In a heavy-duty machine including a ground-supporting base having an operator station, a boom pivotally mounted at one end to the base to swing vertically, a stick cylinder pivotally connected at one end to the boom, a stick pivotally mounted to the free end of the boom to swing vertically relative to the boom, a working tool mounted on the free end of the stick, and a quick-disconnect coupling between the stick and the boom for facilitating the interchangeability of sticks having different tools, whereby the connect and disconnect functions of the coupling are controlled at the operator station, the improvement in the coupling which comprises, a male member on the boom and a female member on the stick, said male member having a pin boss for pivotally connecting one end of the male member to the free end of the boom and a stick cylinder boss at the other end of the male member for pivotally connecting to the other end of said stick cylinder, said bosses being at the backside of the male member, said male and female members having mating faces, intermeshing elements on the mating faces of said male and female members for preventing relative movement along the faces of said members, and locking means operable from the operator station for locking the male and female members together in coupled relation and unlocking the male and female members to allow separation and decoupling, said locking means including a pair of fixed sockets on the female member, the longitudinal axis of each fixed socket being substantially parallel to the longitudinal axis of the female member, a pair of bars on said male member movable longitudinally of the male member and coacting with the mating sockets when the male and female members are together, and means reciprocally driving the bars in opposite directions between locking and unlocking positions and being slidably carried by the male member for longitudinal movement thereon, whereby seating of one bar ahead of seating of the other bar will cause sliding of the driving means until the other bar is seated thereby tightening both bars equally.

2. The improvement of claim 1, wherein the driving means includes an electromechanical means for driving the bars into and out of engagement with the sockets.

3. The improvement of claim 1, wherein the driving means includes a hydraulic means for driving the bars into and out of engagement with the sockets.

4. The improvement of claim 1, wherein the driving means includes a pneumatic means for driving the bars into and out of engagement with the sockets.

5. In a heavy-duty machine including a ground-supporting base having an operator station, a boom pivotally mounted at one end to the base to swing vertically, a stick cylinder pivotally connected at one end to said boom, a stick pivotally mounted to the free end of the boom to swing vertically relative to the boom, a working tool mounted on the free end of the stick, and a quick-disconnect coupling between the stick and the boom for facilitating the interchangeability of sticks having different tools, whereby the connect and disconnect functions of the coupling are controlled at the operator station, the improvement in the coupling which comprises, a male member on the boom and a female member on the stick, said male member having a pin boss for pivotally connecting one end of the male member to the free end of the boom and a stick cylinder boss at the other end of the male member for pivotally connecting to the other end of said stick cylinder, said bosses being at the backside of the male member, said members having mating faces, intermeshing elements on the mating faces of said male and female members for preventing relative movement along the faces of said members, guiding means on the male member coacting with guidable means on the female member to guidably bring the members into mating relationship, the guiding means on the male member including a grabber on one end and a picker on the other end, the guidable means on the female member including a pin mounted transversely to the longitudinal axis of the female member, means for interchangeably mounting the pin at either end of the female member to coact with either the grabber or the picker during coupling, and locking means operable from the operator station for locking the male and female members together in coupled relation and unlocking the male and female members to allow separation and decoupling.

6. The improvement of claim 5, wherein the grabber is mounted at the boom boss end of the male member and the picker is mounted at the stick cylinder boss end of the male member.

7. The improvement of claim 6, wherein the grabber is in the form of a hook generally opening toward the backside of the male member and having a cradle area for receiving the pin of the female member, and the picker is in the form of a hook generally opening in a direction away from the backside of said male member and including positioning hooks for receiving the pin of the female member.

8. The improvement of claim 7, wherein the female member includes aligning means to coact with the male member and assist in lateral alignment of said male and female members when they are coupling.

9. The improvement of claim 8, wherein said aligning means includes aligning arms at opposite sides of the female member between which the male member is guidably received during coupling of the members.

10. The improvement of claim 1, wherein each bar of the locking means is guidably received in a guide bushing carried on the male member, means on each bar coacting with means on its respective bushing to prevent rotation of each bar in its respective bushing and serve as a stop to limit bar movement during uncoupling and to prevent each bar from coming out of the bushing.

11. The improvement of claim 10, wherein the means on the bars includes longitudinally extending keyways or slots, and the means on the bushings includes pins extending into the keyways.

12. The improvement of claim 1, wherein the driving means includes a gearbox and motor assembly and a threaded shaft driven by the assembly, the threaded shaft being threadedly received by the bars.

13. The improvement of claim 1, wherein the driving means includes hydraulic cylinder means connected at one end to one bar and at the other end to the other bar.

14. The improvement of claim 11, wherein the driving means includes a gearbox and motor assembly slidably carried by the male member for reciprocally driving the bars, and a threaded rod driven by the assembly and threadedly received by the bars.

15. The improvement of claim 14, wherein the motor is hydraulically powered.

16. The improvement of claim 1, wherein the female member is connectable to the stick and includes a pair of spaced pin bosses for mating with spaced pin holes on the stick and receiving pins to firmly connect the female member to the stick, one of the pin bosses on the female member having an eccentric bushing to compensate for minor spacing and/or misalignment differences between pin holes on different sticks.

17. The improvement of claim 1, wherein said male and female members further include hydraulic fittings for connecting a source of hydraulic power from the machine to the stick.

18. The improvement of claim 17, wherein the hydraulic fittings include male and female fittings having valve means operable during coupling and uncoupling of the fittings to reduce fluid loss.

19. The improvement of claim 18, wherein said members include means mounting the fittings at opposite sides of the members and aligned such that said fittings will couple as the members are coupled.

20. The improvement of claim 5, wherein the intermeshing elements of each member, the picker and the grabber of the male member, and the mountings for the interchangeable pin are symmetrically arranged such that either end of one member may be aligned with either end of the other member when the members are coupled together.

21. The improvement of claim 5, wherein the intermeshing elements include opposed rows of gear teeth at each side of the members extending longitudinally, and a single tooth at each end of the female member engaging a single tooth socket at each end of the male member.

22. The improvement of claim 5, wherein said locking means includes at least one fixed mating socket on the female member, the longitudinal axis of the fixed socket being substantially parallel to the longitudinal axis of the female member, at least one bar on said male member movable longitudinally of the male member and coacting with the mating socket when the members are together, and means driving the bar between locking and unlocking positions.

23. The improvement of claim 22, wherein the locking means further includes a pair of bars and aligned sockets and said driving means reciprocally driving the bars in opposite directions, said driving means being slidably carried by the male member for longitudinal movement, whereby seating of one bar ahead of seating of the other bar will cause sliding of the driving means until the other bar is seated thereby tightening both bars equally.

24. The improvement of claim 22, wherein the driving means includes an electromechanical means for driving the bar into and out of engagement with the socket.

25. The improvement of claim 22, the driving means includes a hydraulic means for driving the bar into and out of engagement with the socket.

26. The improvement of claim 22, wherein the driving means includes a pneumatic means for driving the bar into and out of engagement with the socket.

27. The improvement of claim 22, wherein the bar of the locking means is guidably received in a guide bushing carried on the male member, means on the bar coacting with means on the bushing to prevent rotation of the bar in the bushing and serve as a stop to limit the bar movement during uncoupling and to prevent the bar from coming out of the bushing.

28. The improvement of claim 27, wherein the locking means includes a plurality of bars and sockets aligned with said bars and the means on the bars includes longitudinally extending keyways or slots, and the means on the bushings includes pins extending into the keyways.

29. The improvement of claim 28, wherein the locking means further includes a pair of bars and aligned sockets and said driving means reciprocally driving the bars in opposite directions, said driving means being slidably carried by the male member for longitudinal movement between the bushings, whereby seating of one bar ahead of seating of the other bar will cause sliding of the driving means until the other bar is seated thereby tightening both bars equally.

30. The improvement of claim 29, wherein the driving means includes a gearbox and motor assembly and a threaded shaft driven by the assembly, the threaded shaft being threadedly received by the bars.

31. The improvement of claim 29, wherein the driving means includes hydraulic cylinder means connected at one end to one bar and at the other end to the other bar.

32. The improvement of claim 22, wherein the female member is connectable to the stick and includes a pair of spaced pin bosses for mating with spaced pin holes on the stick and receiving pins to firmly connect the female member to the stick, one of the pin bosses on the female member having an eccentric bushing to compensate for minor spacing and/or misalignment differences between pin holes on different sticks.

33. The improvement of claim 22, wherein said male and female members further include hydraulic fittings for connecting a source of hydraulic power from the machine to the stick.

34. The improvement of claim 33, wherein the hydraulic fittings include male and female fittings having valve means operable during coupling and uncoupling of the fittings to reduce fluid loss.

35. The improvement of claim 34, wherein said male and female members include means mounting the fittings at opposite sides of the members and aligned such that they will couple as the members are coupled.

36. The improvement of claim 1, wherein said intermeshing elements include mating gear teeth on the male and female members arranged to prevent relative movement in any direction along the plane of the mating faces of the male and female members.

37. The improvement of claim 36, wherein the mating teeth include longitudinally extending opposed rows of gear teeth at each side of the male and female members, and a single tooth at each end of the female member engaging a single tooth socket at each end of the male member.

38. The improvement of claim 1, which further includes guiding means on the male member coacting with guidable means on the female member to guidably bring the male and female members into mating relationship.

39. The improvement of claim 38, wherein said guiding means on the male member includes a grabber on one end and a picker on the other end and the guidable means on the female member includes a pin mounted transversely to the longitudinal axis of the female member, and means for interchangeably mounting the pin at either end of the female member to coact with either the grabber or the picker during coupling.

40. The improvement of claim 39, wherein the intermeshing elements of each member, the picker and the grabber of the male member, and the mountings for the interchangeable pin are symmetrically arranged such that either end of one member may be aligned with either end of the other member when the members are coupled together.

41. The improvement of claim 39, wherein the grabber is mounted at the boom boss end of the male member and the picker is mounted at the stick cylinder boss end of the male member.

42. The improvement of claim 41, wherein the grabber is in the form of a hook generally opening toward the backside of the male member and having a cradle area for receiving the pin of the female member, and the picker is in the form of a hook generally opening in a direction away from the backside of said male member and including positioning hooks for receiving the pin of the female member.

43. The improvement of claim 42, wherein the female member includes aligning means to coact with the male member and assist in lateral alignment of said members when they are coupling.

44. The improvement of claim 43, wherein said aligning means includes aligning arms at opposite sides of the female member between which the male member is guidably received during coupling of the members.

45. The improvement of claim 1, wherein said bars and said sockets are wedge-shaped.

46. The improvement of claim 23, wherein said bars and said sockets are wedge-shaped.

* * * * *